US005090859A

United States Patent [19]

Nanos et al.

[11] Patent Number: 5,090,859

[45] Date of Patent: Feb. 25, 1992

[54] AUTOMATIC BINDING MACHINE USING INSERTION TOOLS

[75] Inventors: Nicholas M. Nanos, Morton Grove; Roger M. Scharer, Des Plaines, both of Ill.

[73] Assignee: General Binding Corporation, Northbrook, Ill.

[21] Appl. No.: 481,852

[22] Filed: Feb. 20, 1990

[51] Int. Cl.[5] ..... B42L 13/04

[52] U.S. Cl. ..... 412/11; 412/40; 412/43; 281/21.1; 281/27.1; 281/27.2

[58] Field of Search ..... 281/21.1, 27, 27.1, 281/27.2; 412/7, 12, 11, 13, 40, 43

[56] References Cited

U.S. PATENT DOCUMENTS

| | | | |
|---|---|---|---|
| 3,122,761 | 3/1964 | Bouvier | 412/40 |
| 3,125,887 | 3/1964 | Bouvier et al. | 412/40 X |
| 3,793,660 | 2/1974 | Sims | 412/40 |
| 3,816,866 | 6/1974 | Miaskoff et al. | 412/12 |
| 4,607,993 | 8/1986 | Scharer | 412/40 |
| 4,610,590 | 9/1986 | Pigna | 412/13 X |
| 4,844,674 | 7/1989 | Tipps et al. | 412/43 |
| 4,900,241 | 2/1990 | Vercillo | 281/21.1 X |
| 4,902,183 | 2/1990 | Vercillo et al. | 412/7 |
| 4,927,310 | 5/1990 | Abildgaard et al. | 412/7 |

FOREIGN PATENT DOCUMENTS

| | | | |
|---|---|---|---|
| 830636 | 2/1952 | Fed. Rep. of Germany | 412/40 |
| 2362440 | 6/1974 | Fed. Rep. of Germany | 412/40 |

*Primary Examiner*—Paul A. Bell

*Attorney, Agent, or Firm*—Hill, Van Santen, Steadman & Simpson

[57] ABSTRACT

There is provided herein a binding apparatus for use with a cartridge having at least one curled-finger ring-type edge binder, which apparatus is adapted to bind prepunched sheets together and form a booklet. The binding apparatus defines a binding position and includes cartridge support means for supporting a cartridge having at least one binder therein at the binding position, paper guide means for guiding sheets of paper with prepunched apertures to the binding position, insertion tool means for axial insertion into the binder to bind same to receive sheets therein, and clamp means are provided for selectively receiving paper for binding and for positioning the binder means at the clamping position.

21 Claims, 10 Drawing Sheets

A
238
BLINK CARTRIDGE LAMP
236
CARTRIDGE IN PLACE ?
N
Y
TURN CARTRIDGE LAMP OFF
240
E
ROTATE TOOL DRUM TO SELECT TOOL SIZE
242
244
$t_3$ ?
Y
246
BLINK FAULT LAMP
N
248
N
TOOL SELECTED ?
Y
250
PAPER IN THROAT ?
Y
252
BLINK FAULT LAMP
N
254
N
PAPER REMOVER ?
Y
256
TURN FAULT LAMP OFF
258
CARTRIDGE SW. ACTIVATED ?
Y
260
EJECT CARTRIDGE
N
262
N
INITIATE BIND CYCLE ?
Y
F
MOVE CLAMP TO FEED POSITION
264
G

G
266
t4 ?
Y
N
270
BLINK FAULT CLAMP
268
CLAMP IN FEED POSITION ?
N
Y
OPEN BINDER
272
274
t5 ?
Y
N
278
BLINK FAULT CLAMP
276
BINDER OPENED ?
N
Y
280
MOVE CLAMP TO LOAD POSITION
282
t6 ?
Y
N
284
BLINK FAULT CLAMP
286
CLAMP IN LOAD POSITION ?
N
Y
288
TURN ON READY LAMP & SET TIMER
290
PAPER IN THROAT ?
N
Y
294
TIMER = 0
Y
N
D
292
BIND SW. ACTIVATED ?
Y
N
296
CARTRIDGE SW. ACTIVATED ?
Y
N
298
TIMER = 0 ?
N
Y
D
B
C

B
MOVE CLAMP TO CLAMP POSITION
300
302
t7?
Y
304
BLINK FAULT LAMP
N
306
CLAMP IN CLAMP POSITION?
N
C
Y
RETRACT TOOL HOME
308
310
t8?
Y
312
BLINK FAULT LAMP
N
314
TOOL HOME?
N
Y
TURN OFF READY LAMP & RESET TIMER
316
TURN ON REMOVE BOOK LAMP
318
320
BOOK REMOVED?
N
Y
322
TURN OFF REMOVE BOOK LAMP
BLINK FAULT LAMP
328
324
MOVE CLAMP HOME
332
CARTRIDGE SW. ACTIVATED?
N
F
326
t9?
Y
Y
EJECT CARTRIDGE
N
330
CLAMP HOME?
N
Y
E

AUTOMATIC BINDING MACHINE USING INSERTION TOOLS

BACKGROUND OF THE INVENTION

This invention relates to a binding machine for forming booklets from prepunched sheets, and more specifically, to an apparatus for applying curled-finger ring-type binder to prepunched sheets where the binders may be carried in a cartridge.

The use of plastic curled-finger ring-type edge binders for forming booklets with prepunched materials is known. One class of equipment is the office-style punch-and-binding machine as disclosed in U.S. Pat. Nos. 3,122,761; 3,125,887; 3,227,023; 3,793,660; and 4,645,399. These machines are used to apply ring-type edge binders to prepunched sheets, usually paper, so as to form bound booklets. A ring-type edge binder includes an elongated spine having a plurality of curled fingers spaced therealong. (See, for example, U.S. Pat. No. 1,970,258.) Each finger has one end integral with one edge of the spine, and the other end of the finger is free but resiliently engages the other edge of the spine. In prior art machines, the binder was held in a comb and L-shaped machine fingers were manipulated to engage the binder fingers and to spread them from the spine so as to open the binder for fitting of prepunched sheets onto the open fingers and then to close the fingers so as to firm the booklet by binding the sheets together with the edge binder.

German Patentschrift 830636 and German Offenlegungsschrift 2362440 disclose a hand-operated paper editing device which is axially inserted into the end of a binder for spreading the fingers. U.S. Pat. No. 2,234,045 shows a tapered hand-operated opening device.

In recent developments an improved insertion tool and portable system has been developed for opening a binder and a binding booklet. (See also U.S. Pat. No. 4,900,211 and U.S. patent application Ser. No. 346,918 filed May 1, 1989.)

In some circumstances, as in an office, a heavy-duty, faster and more flexible machine or apparatus is desirable. Moreover, it is desirable for such machines to employ a replaceable binder system from which booklets of different thicknesses and different colors can be formed and bound. This requires the selective use of different diameter and/or different color edge binders. A cartridge system which carries such edge binders is disclosed in U.S. patent application Ser. No. 481,857 filed Feb. 20, 1990 and entitled "Cartridge System for Tool Insertion Type Binding Machine". Now U.S. Pat. No. 5,051,050.

It is therefore an object of this invention to provide an office-style binding machine suitable for using an insertion-type tool to open the binder and bind the sheets therewith.

It is another object of this invention to provide an office-style binding machine which is suitable for use with a cartridge carrying binders of different types.

These and other objects of this invention will become apparent from the following disclosure and appended claims.

SUMMARY OF THE INVENTION

There is provided by this invention a heavy-duty, office-style binding machine employing an insertion tool type opening device for forming booklets by binding prepunched sheets together. This machine is particularly suitable for use with a cartridge which carries the binders.

The machine includes guide means for receiving a binding tool cartridge and guiding a binder in the cartridge to a binding position. Paper guide means are provided for receiving prepunched paper and delivering the same to the binding position. An insertion tool drum extension, retraction and storage system is provided for storing the different sizes of insertion tools and inserting the appropriate tool into a binder at the binding position so as to open the same and receive prepunched sheets. A clamping system is provided for selective use with binders of varying sizes to assure alignment of the prepunched sheets with fingers of the binder. Sensors are provided in various positions to detect the presence of a cartridge, the presence of a binder, to determine the type of binder within the cartridge, actuate the insertion tool, and to sense the tool insertion step and withdrawal step. A control means coordinates the operation of the binding apparatus, namely the cartridge, the paper guide insertion tool, clamp and sensors for the purpose of forming a bound booklet.

DESCRIPTION OF THE PREFERRED EMBODIMENT

Figure 1:
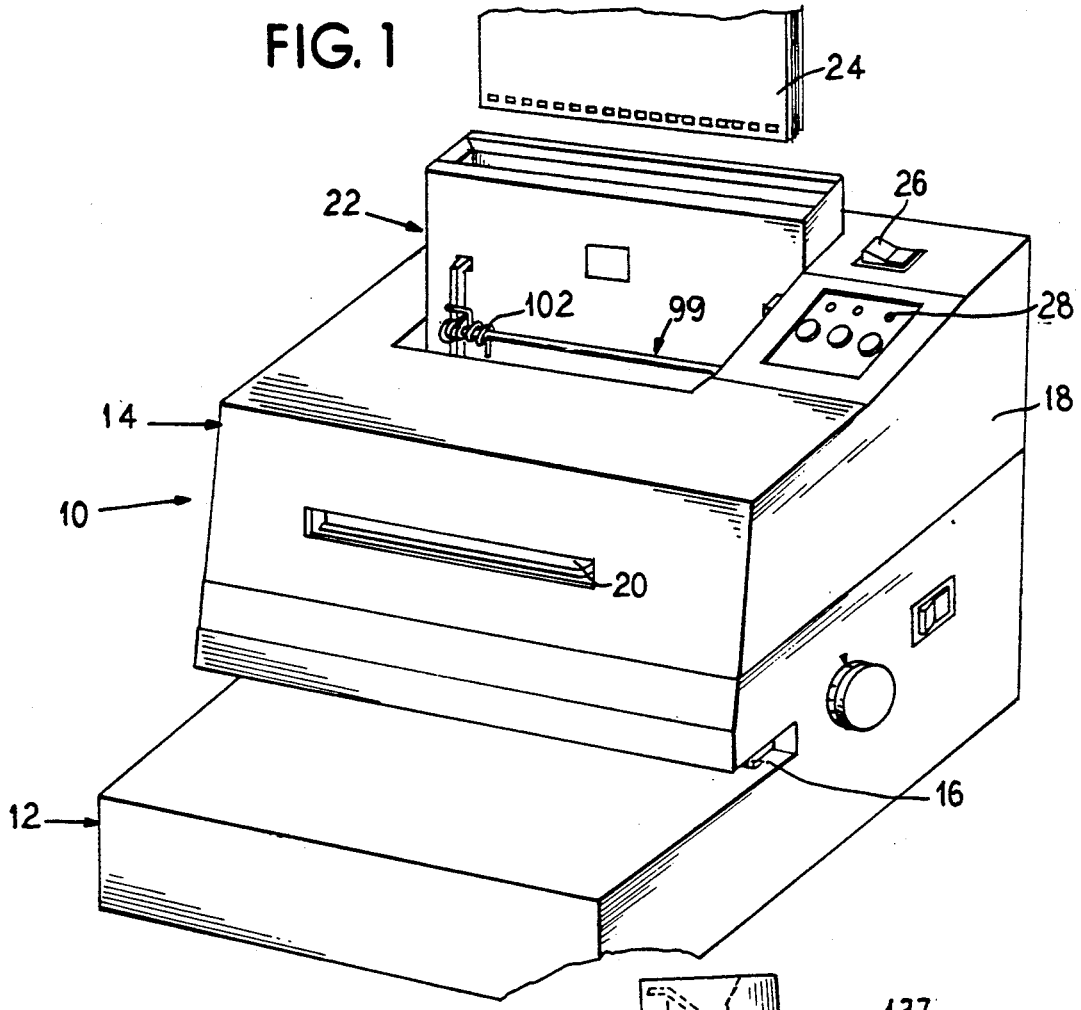
FIG. 1 is a perspective view of a combined binding and punching machine.

Referring now to the drawings, the combined binding and punching system is referred to as 10 generally. The apparatus includes a base 12 and housing 14. The punch system 16 is generally of a known type and is shown in FIG. 1 encased in the lower portion of the housing 14. However, the punch has a sensing provision which disables the punch mechanism if paper to be punched is misaligned. This insures that the backgauge positions of the punched holes is accurate and consistent. The binding system is formed in the upper portion of 18 of the housing. The binder system generally includes the cartridge-receiving area 20, the paper guide 22 for receiving sheets of prepunched paper, such as 24, and internally of the housing there is provided the insertion system/clamping system at the binding position as well as the various sensors. An appropriate power switch 26 is shown along with the control panel 28.

Binder and Cartridge

Figure 2:
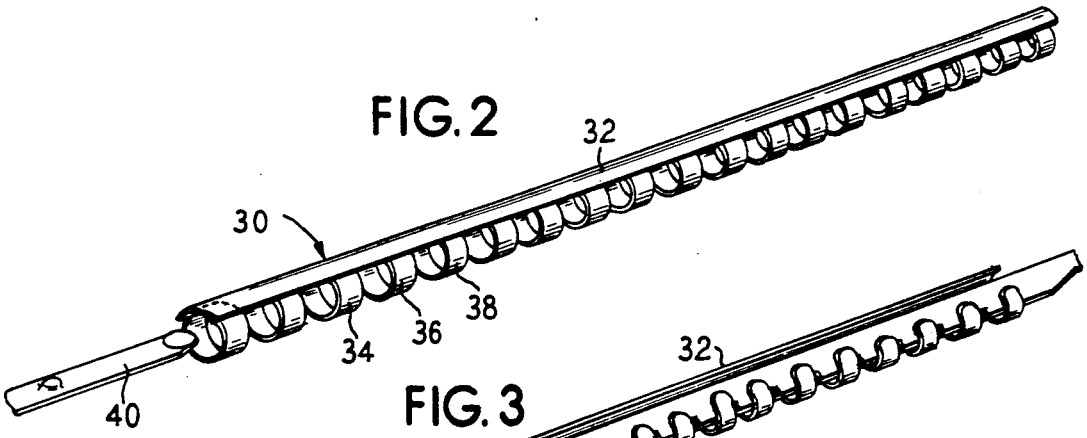
FIG. 2 is a perspective view showing a ring-style binder with insertion tool about to be inserted in there.
Figure 3:
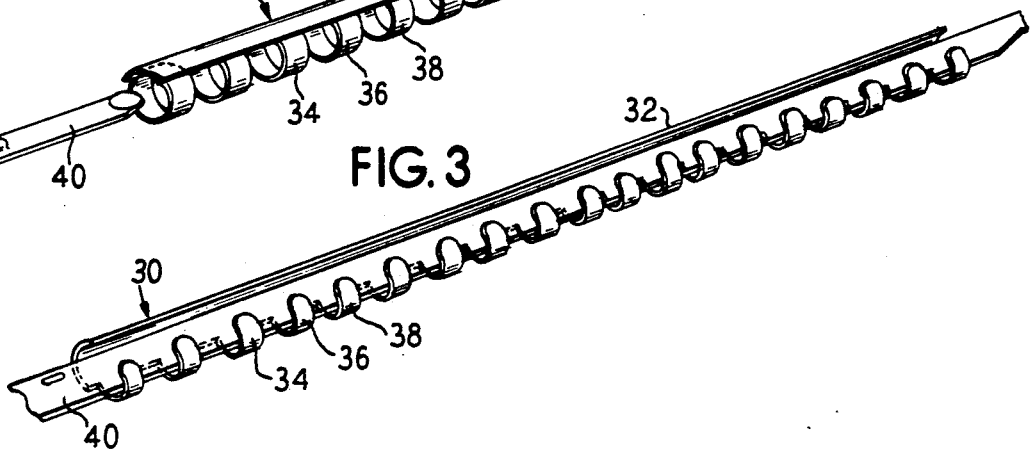
FIG. 3 is a perspective view showing an open ring-style binder with the insertion tool therein.

The binder system generally includes the ring-style binder 30 generally, which includes the binder spine 32 having spaced therealong curled fingers such as 34, 36 and 38. For example, see FIGS. 2 and 3. A tape-like insertion tool such as 40 is shown in FIG. 2 axially aligned with the binder so as to open the same. The opening is shown in FIG. 3 wherein the fingers are separated from the rotating spine due to insertion of the tool 40 so as to form an upwardly facing gap into which paper can be deposited. It is to be noted that the binder spine has in effect rotated from a substantially horizontal to substantially vertical position by the insertion of the tool 40.

Figure 4:
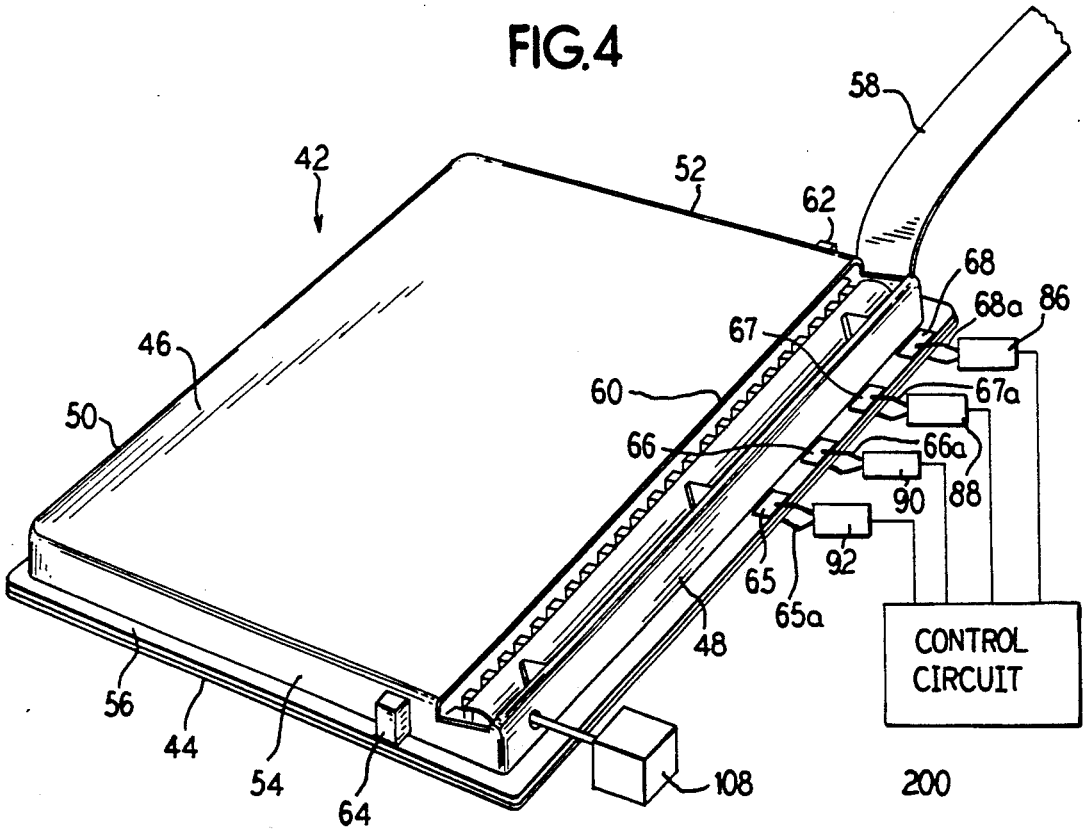
FIG. 4 is a perspective view showing the cartridge for the insertion tool.

Binders 30 can be carried in cartridges, such as cartridge 42 shown in FIG. 4, which are vacuum formed and have a bottom portion 44, top portion 46, front wall 48, back wall 50, side walls 52 and 54, and a peripheral edge 56. A removable strip 58 is provided which exposes a binding slot 60, at which the binder can be positioned.

Side protrusions 62 and 64 for cooperation with the paper guide caliper arms are also molded into the cartridge. Several indicator pads, such as 65, 66, 67 and 68, are provided on the peripheral edge of the cartridge adjacent the front for identifying the types of binders carried in the cartridge. A detailed description of the cartridge will be found in U.S. patent application Ser. No. 07/481,857 entitled "Cartridge System for Tool Insertion Type Binding Machine", filed of even date herewith, now U.S. Pat. No. 5,051,050.

Also shown schematically in FIG. 4 are contact members 65*a*, 66*a*, 67*a* and 68*a* which electrically contact the indicator pads 65, 66, 67 and 68 to detect an encoding representative of the characteristics of the cartridge and the binders therein, for example, the size of the binders, etc. Sensors 86, 88, 90 and 92 are provided for each contact member 66*a*, 67*a*, 68*a* and 69*a*, the sensors being connected to a control circuit shown generally at 200. The sensors 86–92 sense whether the corresponding indicator pad is an open circuit or a short circuit. The combination of the sensor outputs is an encoding of the cartridge and binder characteristics. The number of indicator pads and sensors depends upon the maximum number of different characteristics desired to be sensed. In the present device, four indicator pads are provided. It is also contemplated to provide other sensing indicating means than those shown. For example, spring biased pins connected to electrical contacts which sense the presence or absence of holes in the cartridge may be provided. Also optical sensors which sense the presence of holes may be used.

The Binding Apparatus—Cartridge Support

Figure 8:
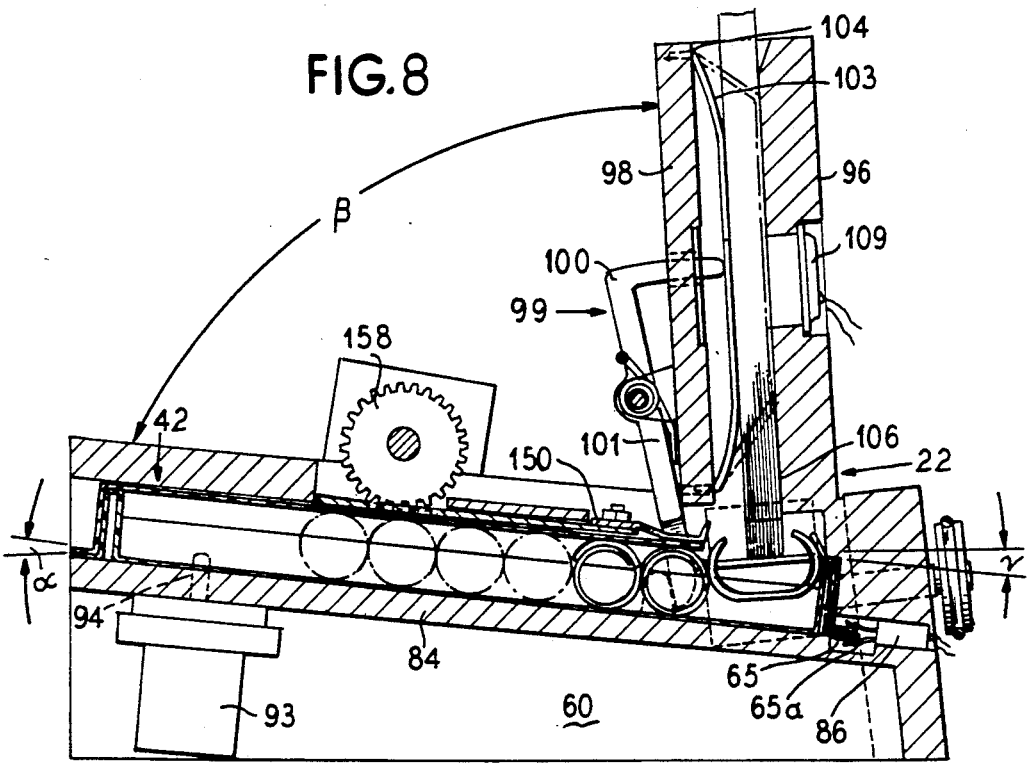
FIG. 8 is an elevational and sectional view showing the paper guide system in binding system.
Figures 6, 9:
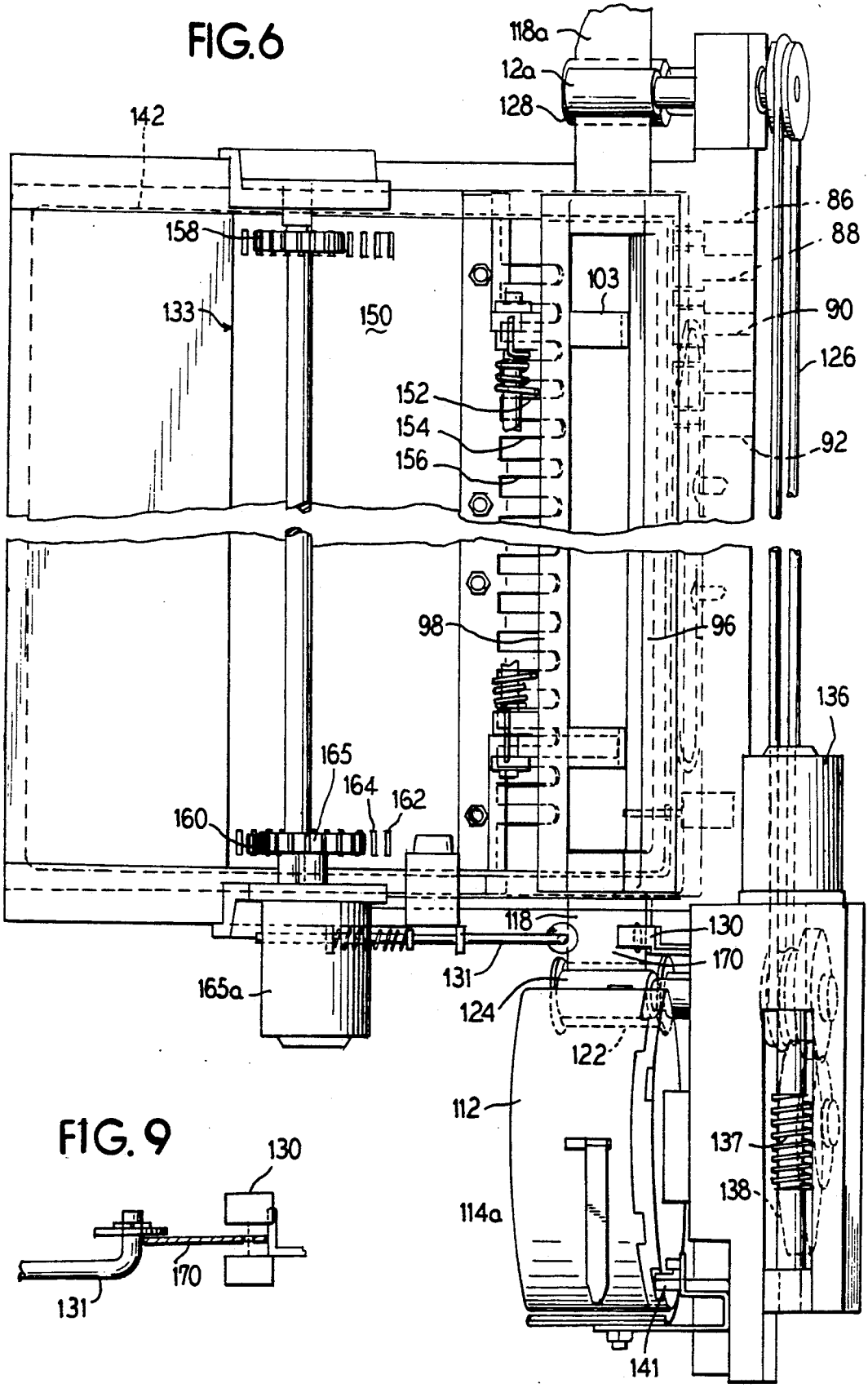
FIG. 6 is a top plan view showing the clamping system and the cartridge support system.
FIG. 9 is an elevational and sectional view showing a sensor system used in connection with the tool advancing or insertion system of FIG. 6.

Referring to FIGS. 6 and 8, it is seen that the cartridge, such as 42, is supported on an angle support plate 84 which is positioned at an angle alpha ($\alpha$) to horizontal, which angle is about 5°. The support plate 84 extends from the operator side of the machine to the back side of the machine. Associated with the machine and the support plate are a plurality of sensors such as 86 in FIG. 8 and 86, 88, 90, and 92 in FIG. 6, each of which engage a conductive pad on the cartridge to sense the diameter, color, and information of that type from the cartridge. When the cartridge is in the home position, the interlock system or solenoid 93 and plunger 94 engages the cartridge 42 and the plunger is inserted into the cartridge, thereby indicating that the cartridge is in position. The plunger locks the cartridge in position and acts as a sensor relative to its presence.

Paper Guide

In the operative position, the binding slot 60 is positioned at the binding position at the bottom of the paper guide 22. The paper guide 22 generally includes two stationary plates 96 and 98. A paper thickness caliper system 99 is pivotally mounted to the rear plate and has two L-shaped arms, such as 100, to control the thickness of paper in the guide, and lower arms, such as 101, to be engaged by the cartridge protrusions such as 62 and 64. The caliper system is spring biased to a closed position by a torsion bar and spring system 102. The caliper system also ejects cartridge via spring force when solenoid 92 is released. The plate 98 includes elongated, generally vertically-extending rib-like springs, such as 103, that engage the calipers and the paper and control thickness of the paper to be accepted and also permit a bound booklet to be withdrawn from the paper guide.

The front and back plates define an entry throat 104 and an exit throat 106 that cooperate in guiding paper through the paper guide. The paper guide is tilted with respect to the horizontal at an angle beta ($\beta$). In this case $\beta$ is approximately 82°. A sensor, such as 108, is provided for determining whether a binder in a cartridge is in the binding position. Another sensor 109 detects presence of paper in the entry/exit throat.

Tool Insertion and Retraction System

Figure 7:
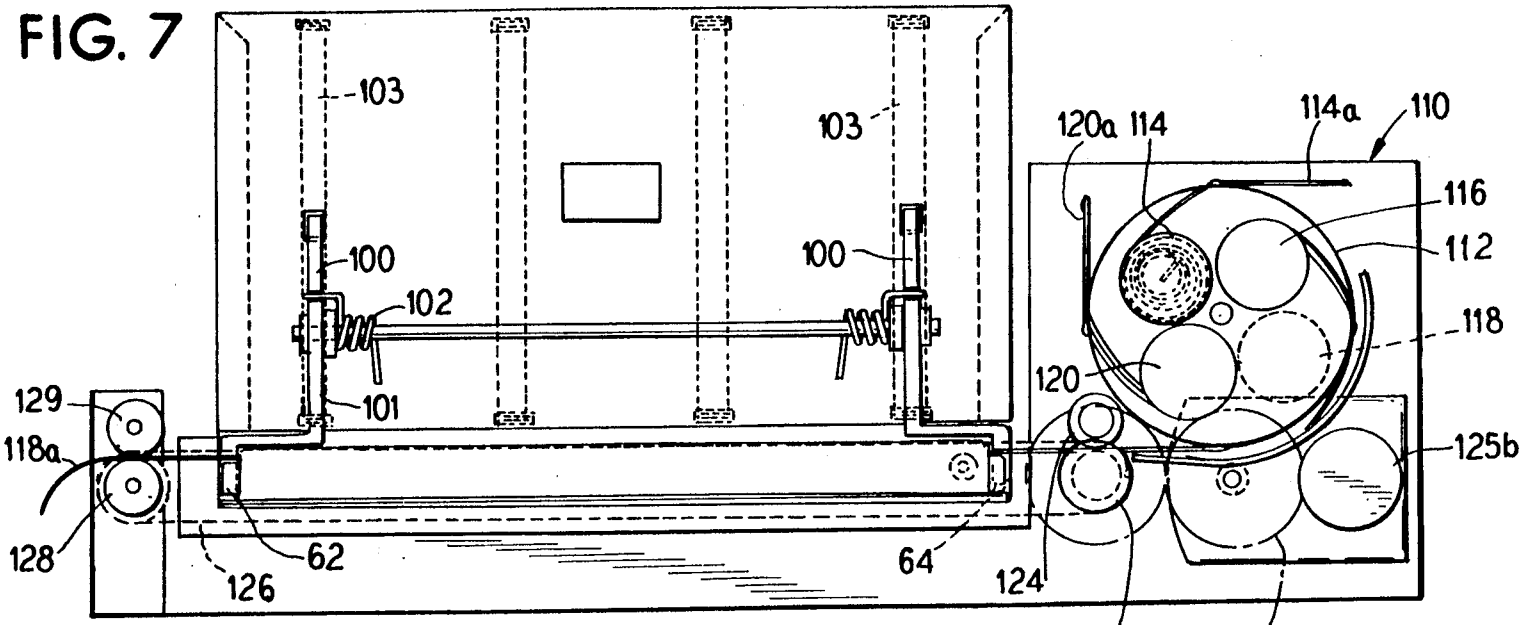
FIG. 7 is a front elevational view showing the insertion tool system.

Once the binder cartridge is in position and paper is to be delivered, it is essential to select an opening tool and insert the same through the binder. One type of system is best seen in FIGS. 6 and 7. The tool insertion and retraction system 110 includes a rotatable drum 112 that houses four separate insertion tools 114, 116, 118 and 120. An appropriate tool is selected by microprocessor control and inserted into the nip of the drive and idler rollers 122 and 124. These rollers are connected by a drive belt 126 to the remote drive 128 and idler 129. It is noted that the first set of drive and idler wheels 122 and 124 is on one side of the binder apparatus and the other 128 and 129 is on the other side. The drive and idler rollers are driven by the gear 125*a* and drive motor 125*b*.

Briefly, the drum 112 is rotated, a tool, such as tool 118, engages the nip of the first drive rollers 122 and 124 and is urged through a binder 30 as it is withdrawn from the drum. That tool then extends to and engages the second drive rollers 128 and 129. In this way the binder 30 is spread open and the fingers and spine separated so as to be in position to receive a stack of paper. In order to close the binder 30, the tool is moved in exactly the opposite direction. It is essential that the operation of the tool drum be understood in detail.

Figure 5:
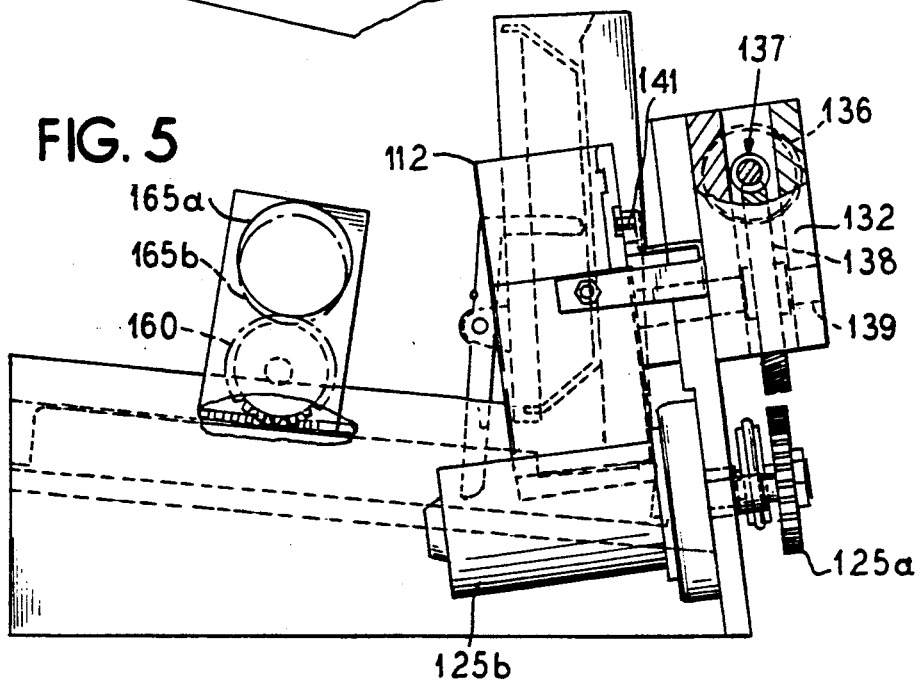
FIG. 5 is an elevational and sectional view showing the positioning of the binding apparatus, paper guide, and insertion tool apparatus.

In FIGS. 5, 6 and 7, it can be seen that the tool drum is rotated by a gear assembly 132. The gear assembly includes a motor 136 that drives a worm 137. That gear in turn drives a worm gear 138. Gear 138 has a shaft 139, which connects to the cartridge drum 111. The worm gear prevents any backlash or release of tolerance on the casing or movement of the casing.

The drum casing 112 rotates in a clockwise direction so that the tail on each of the insertion tools 114, 116, 118 and 120 pass the nip as is shown. When the appropriate size of the tool, as determined by the control means through the sensors 86–92, passes the nip, then the drum casing is reverse rotated so as to push the tip of the insertion tool into the drive roller nip. The positioning and operation of the drum casing is controlled by a microprocessor and sensor 141. The insertion tool, such as tool 118, has a lead front end 118*a* which has a length a little bit longer than the binder 30, and once fed through the binder 30 and to the take-up rollers 128 and 129, the wider portion of the insertion tool 119 is pulled through the binder to fully open the binder. In this way the correct size insertion tool is determined and used.

A sensor 130 is provided for detecting the presence of an insertion tool in the nip. The illustrated sensor 130 is an optical receiver and arranged so that the insertion tools interrupt the light beam, which may be an infrared beam, when the insertion tool is in position in the binder. Once the tip of the insertion tool is detected, the clamping system as described hereinafter is activated. The sensor 130 can also detect a slot in the insertion tool which represents the end of the tool or its travel. A spring-loaded rod 131 pushes the insertion tool rearwardly so as to keep the tool in the correct path.

The Clamping System

In addition, the machine includes a clamping system 133 for positioning, guiding and feeding of the binder and receipt of the paper in the event of certain conditions. Generally speaking, the clamping system includes a plate or clamp 150 that is positioned above and on top of the cartridge 42. The plate as seen in FIG. 6 includes a plurality of fingers such as 152, 154 and 156. A drive mechanism which includes a pair of spaced spur gears, such as 158 and 160, is provided to rotate in the rack-like slots, such as 162 and 164, in the plate so as to advance the plate to a position where it engages the top surface of the binder positioned just before the binding position and under microprocessor control the fingers can receive paper which is deposited thereon. The drive includes motor 165*a* that rotates gear 165*b* that communicates with a spur gear such as 158. It is to be noted that the operation of the drive for the clamping plate is related to the sensors or tabs on the cartridge as well as the positioning of the tool and the nip. Very briefly what occurs is the plate 150 is advanced toward the binder position slot, can engage the binder and, if appropriate, can engage the paper. In some cases it will withdraw to clamp the paper thereon so as to grasp the paper and assure alignment of the binder fingers with the cartridge.

In general, the plate and binder fingers are advanced to guide all fingers or actuators to insertion and retraction positions only in situations where the binder is of a relatively small diameter such as one-fourth inch and three-eighth inch in diameter. In that case the paper falls and engages the insertion tool directly as shown in FIG. 8. However in other situations such as where the binder is of a larger diameter, such as one-half inch and five-eighth inch, the plate actually extend between the binder fingers so as to receive paper falling thereon and then retracts to tighten and grasp the paper and in effect clamp the paper for binding. At the end of binding there is a small jogging motion which occurs.

The clamp or plate 150 can be thought of as moving to a feed position, a load position, where the paper falls on the clamp 150 to a clamping position where there is a retraction of the clamp so as to tighten the paper, a jog and remove position so as to loosen the paper and remove the clamp and home position.

Figure 13:
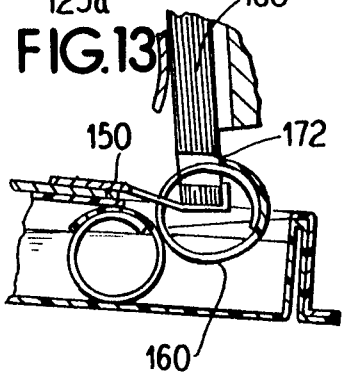
FIGS. 10, 11, 12, and 13 are elevational and sectional views showing the operation of the clamping system in relation to the binder and binding operation.
Figure 12:
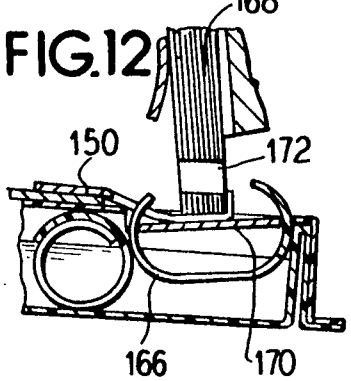
Figure 11:
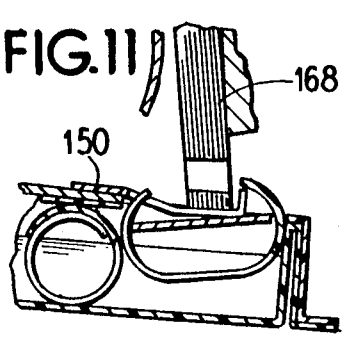
Figure 10:
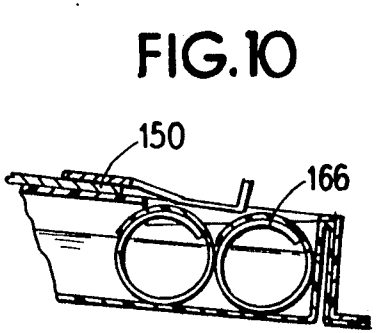
Figure 14:
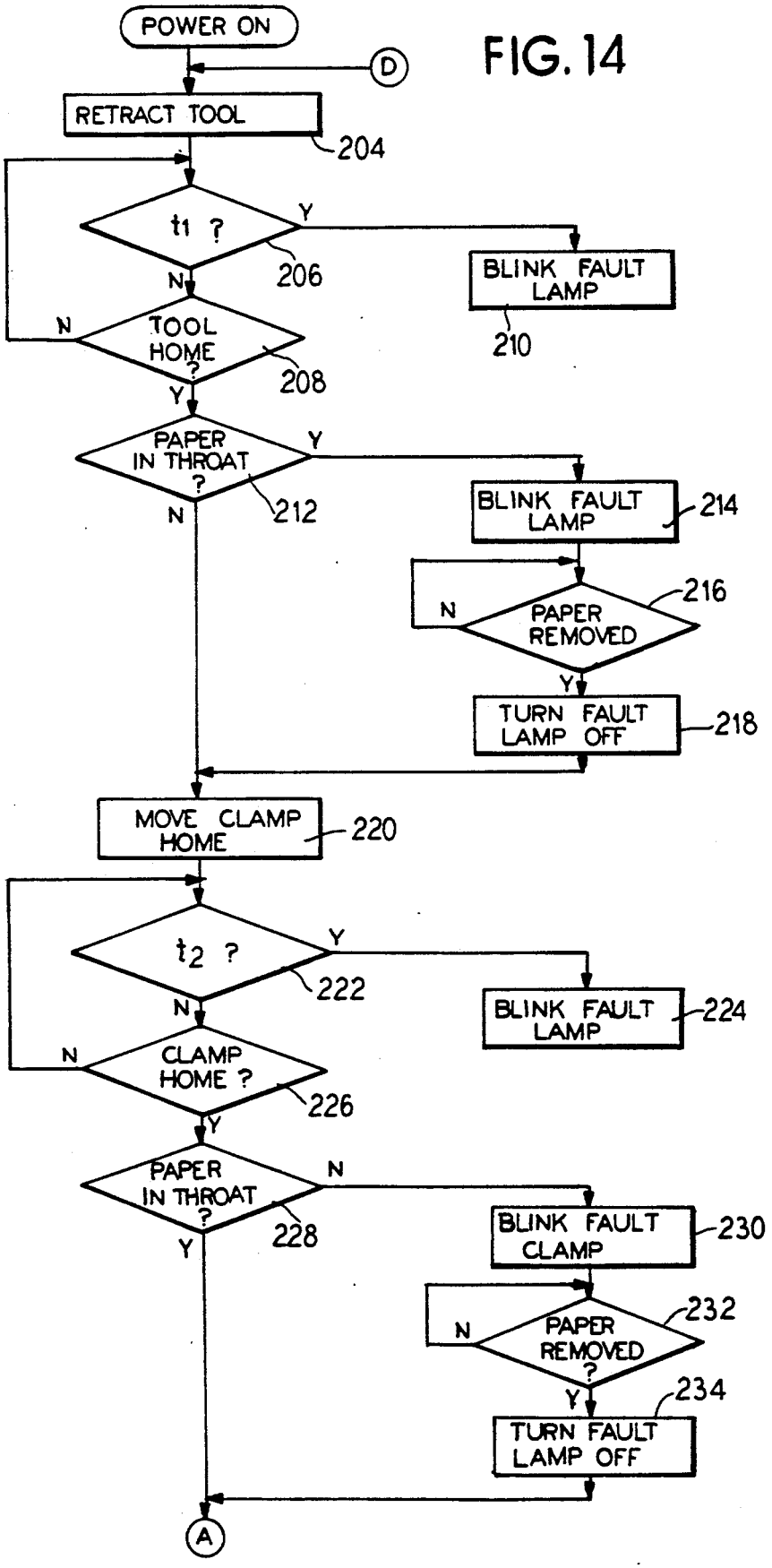
FIGS. 14, 15, 16 and 17 are portions of a flow chart showing the operation of the combined binding and punching machine.

Referring to FIGS. 10–13, it is seen that the clamping plate, such as 150, advances to engage the top of a binder. such as 166. Where the binder is of a large diameter, the clamp continues so that the paper, such as 168, which is fed into the paper guide falls on the clamp rather than on the insertion tool such as 170. The fingers clamp the paper between the upstanding end leg of each finger and the rear plate of the paper guide 22. This aligns the apertures in the paper, such as 172, for receipt of fingers on the binder 166. When the binders are aligned and the papers aligned, the tool 170 is withdrawn, as seen in FIG. 13, and the fingers snap through the binder as shown in FIG. 13. Thereafter, the book can be withdrawn and at the same time the clamp moves to the rearward position.

The foregoing operation is controlled in the following way and by the following apparatus:

FIGS. 14–17 show a flow chart for the operation and control of the automatic binding apparatus of the present invention. The operation of the apparatus is initiated in FIG. 14 by turning on the power switch 26 at step 202, whereupon the control circuit for the present device immediately retracts any insertion tool which may be in an extended position, at step 204. Since it is desired that the tool retraction occur within a predetermined maximum time, such as 3 seconds, the timer step 206 determines whether a predetermined time interval $t_1$ has expired. If less than the predetermined interval $t_1$ has expired, a check is made at step 208 to determine whether the tool is in the home position. If not, a branch of the flow chart loops back to continue timing the time interval. If the predetermined time interval $t_1$ expires, then a branch from block 206 triggers blinking of a fault lamp in block 210.

Assuming fault free operation, the apparatus senses the tool in the home position before the expiration of the predetermined time interval $t_1$ and moves to block 212 to sense whether paper is in the throat of the device. If paper is sensed in the throat of the device, a blinking fault lamp is turned on at block 214 and the operating circuit continues to check for paper removal at block 216 until the paper has been removed, which causes the fault lamp to be turned off at block 218.

If no paper was found in the throat or if the paper found in the throat has been removed, the control moves the clamp to a home position at block 220. This likewise is timed over a predetermined time interval $t_2$, such as two seconds at block 222 to determine whether the time interval has expired. If the time interval $t_2$ expires, the fault lamp is blinked in block 224, but if the sensor determines that the clamp is in the home position, in block 226, before the expiration of the time interval $t_2$, then a sequence of steps 228, 230, 232 and 234 which are substantially equal to the steps 212, 214, 216 and 218, respectively, are carried out to determine whether paper is in the throat.

Figure 15:
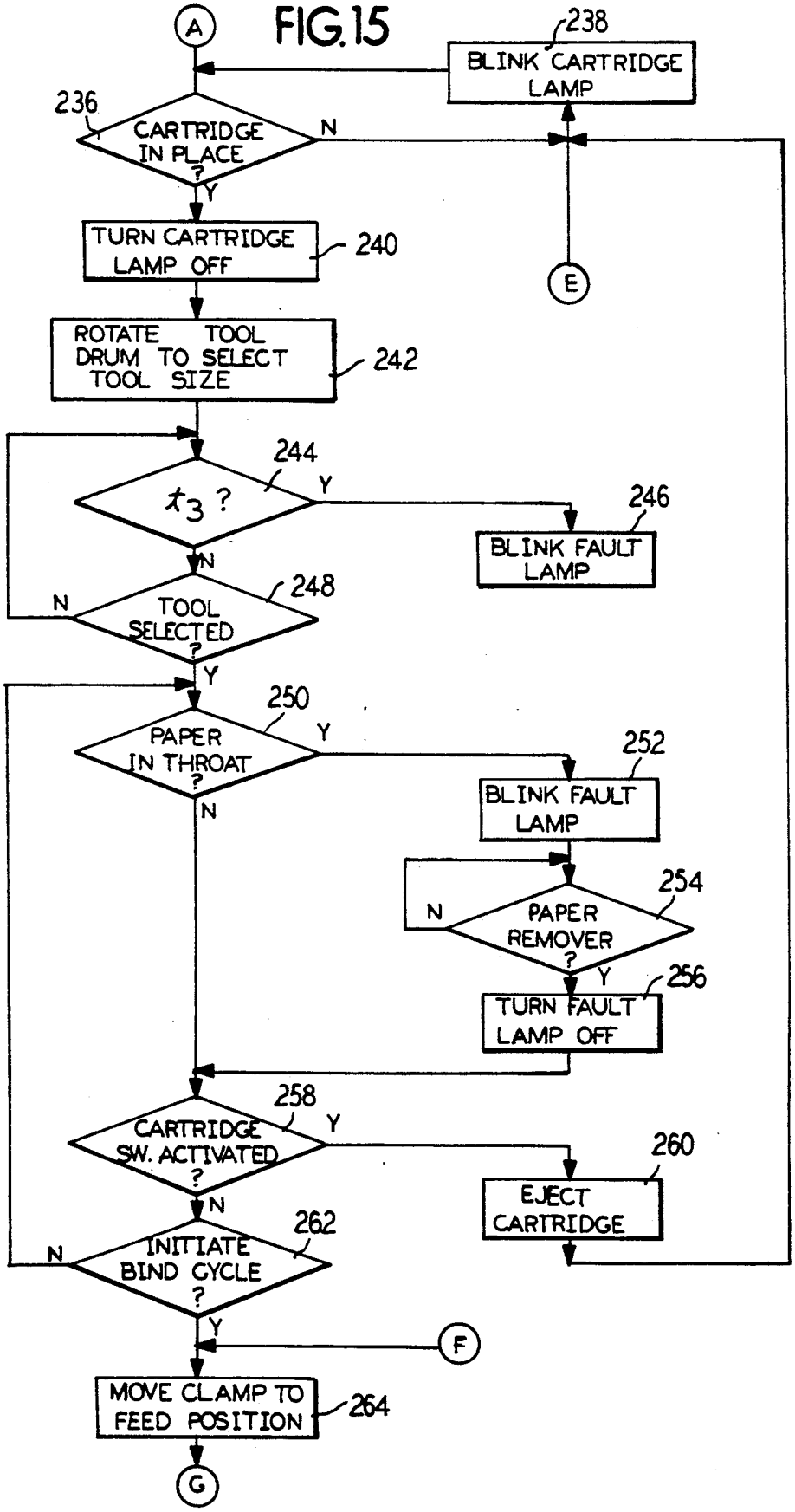

Following these steps, a determination is made as to whether a binder cartridge is in place, at step 236 as shown in FIG. 15. If not, the cartridge lamp is blinked at step 238 until the cartridge is in place. Once a cartridge is sensed, the cartridge lamp is turned off at step 240 and the tool drum is rotated to select the appropriate tool size for the cartridge at step 242. A maximum time $t_3$ of, for example, five seconds is allowed for the selection of the appropriately sized tool, as determined by step 244. As before, if the time interval $t_3$ expires then a fault lamp is blinked at step 246; on the other hand, if the tool is selected within the time interval $t_3$, this is sensed at block 248 and the control process again checks to determine whether there is paper in the throat of the device, at steps 250, 252, 254 and 256.

After determining that no paper is in the throat, the step 258 determines whether the cartridge switch is activated. If the cartridge switch has been activated, there are no more binders in the cartridge and the cartridge is ejected at step 260, after which the cartridge lamp is blinked at step 238. If the cartridge switch is not activated, indicating the presence of at least one binder in the cartridge, then the bind cycle is initiated at step 262 and the clamp is moved to the feed position at step 264.

Figure 16:
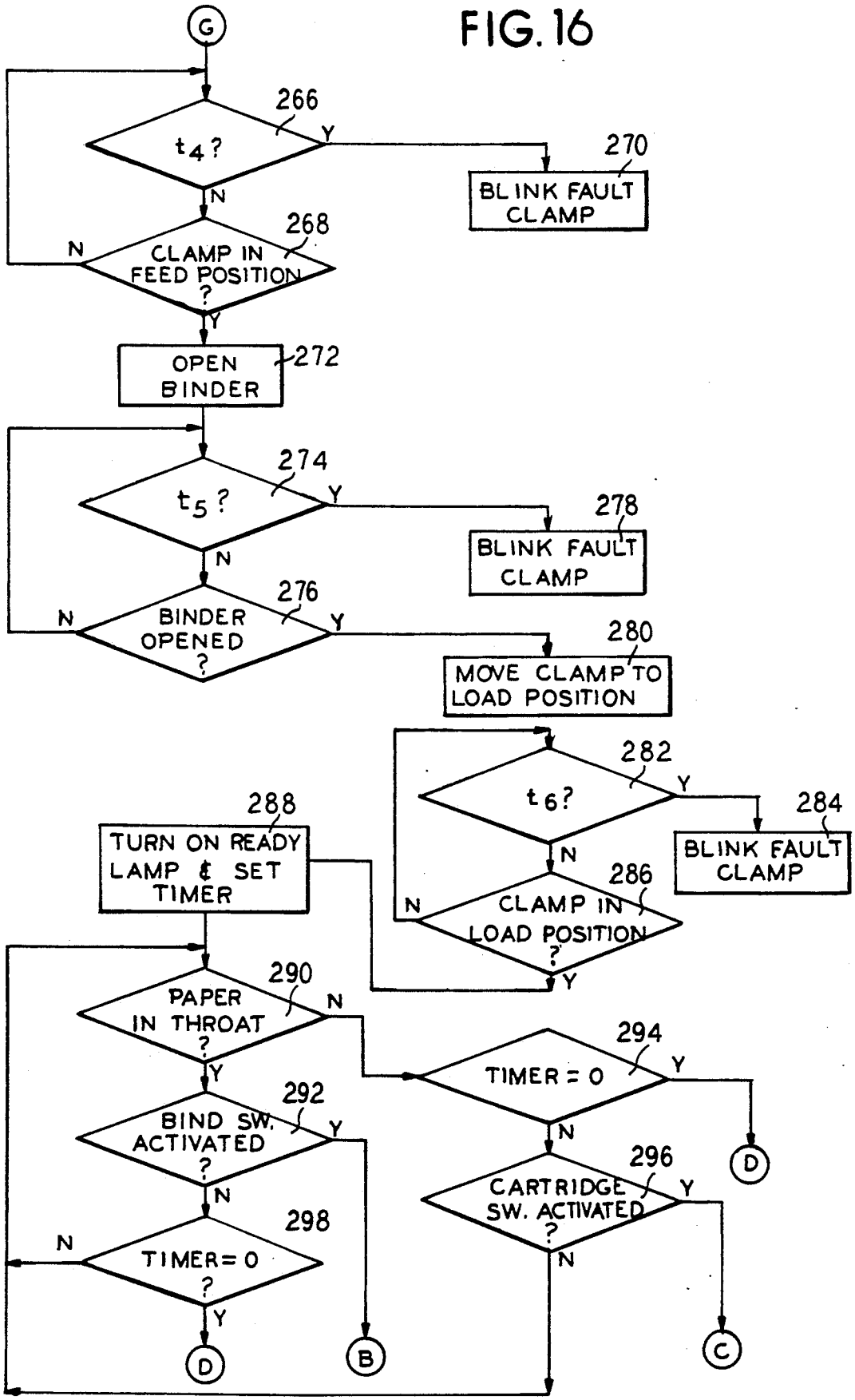

Continuing in FIG. 16, a time interval $t_4$, for example two seconds, is measured at block 266 to determine if the clamp reaches the feed position, in block 268. If not, the fault lamp is blinked at block 270. Once the clamp is in the feed position, the binder is opened at block 272. The time interval $t_5$ of, for example, three seconds in block 274 which is permitted for the opening of the binder, which is checked at block 276. If the binder is not open after the time $t_5$, the control blinks the fault lamp at block 278. Once the binder is opened, the clamp is moved to the load position at block 280, a time interval $t_6$ of, for example, one second being allowed for opening of the clamp via blocks 282, 284 and 286.

Once the binder has been opened and the clamp moved to the load position, a ready lamp is turned on and a timer, which is in this embodiment a five minute timer, is set at step 288. The throat paper sensor is checked at step 290, and if paper is in the throat, a determination is made in step 292 as to whether the bind switch is activated. On the other hand, if no paper is sensed in the throat in step 290, a check of the timer is made at step 294 and if the timer has counted down to zero the control is returned via connector D to the beginning of the control sequence in FIG. 14. If the timer has not reached zero, the cartridge switch is checked in step 296. Activation of the cartridge switch transfers control through connector C to the portion of the flow chart shown in FIG. 17. Lack of activation of the cartridge switch transfers control back to step 290. If the control process reaches step 292 and the bind switch is not activated, a check is made of the five minute timer to see if it has reached zero at step 298. If the timer has reached zero, then the connector D transfers control of the process back to the beginning in FIG. 14. If the timer has not reached zero, then control is transferred back in a loop to block 290.

Figure 17:
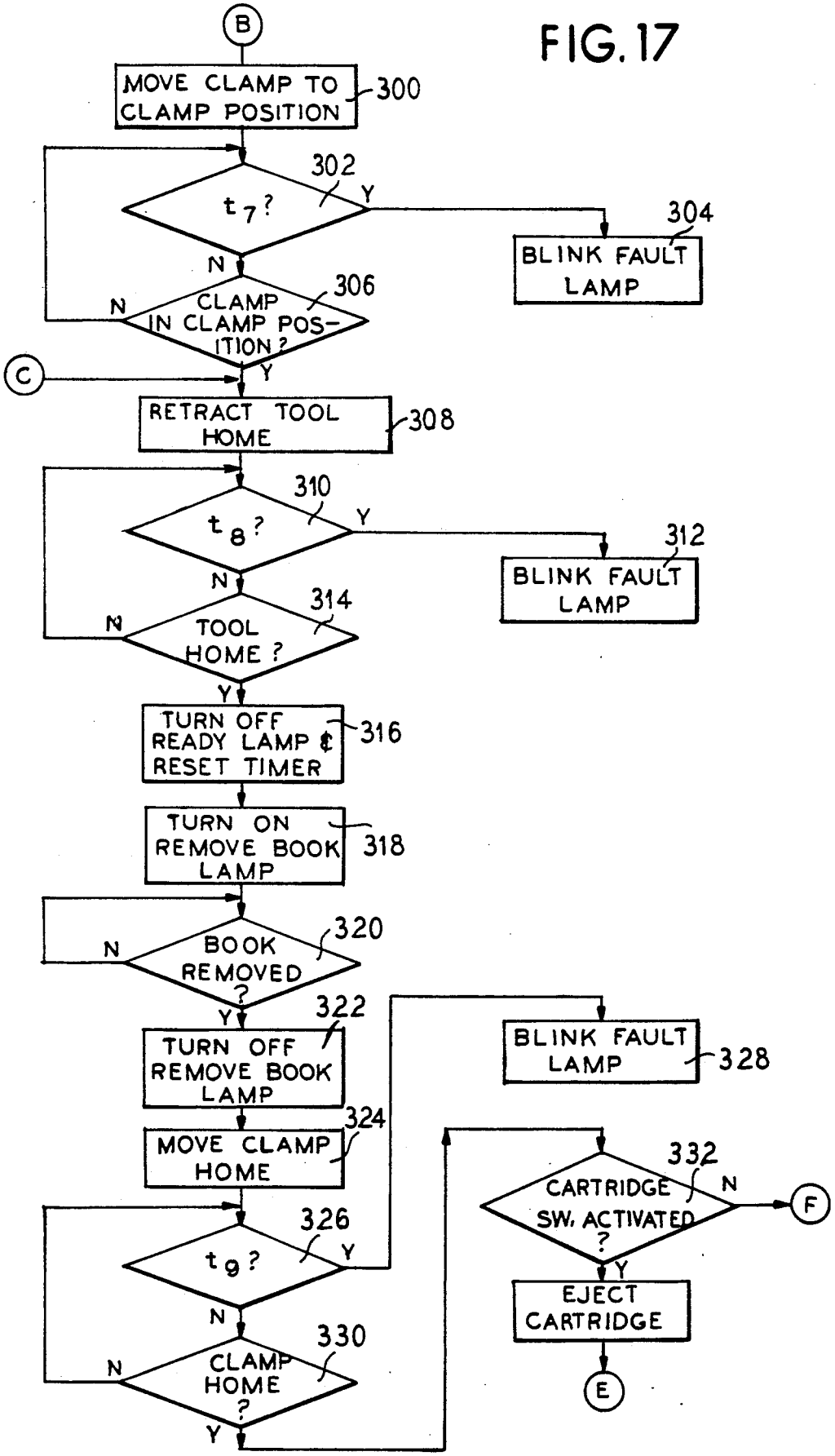

Referring once again back to block 292, if the bind switch is activated, the connector B transfers control to FIG. 17 wherein block 300 indicates movement of the clamp to the clamp position. As with many of the other actions taken in this process, a time interval $t_7$ which is, for example, one second, is measured in block 302 and if the time $t_7$ expires before the clamp is in the clamp position then the fault lamp is blinked in block 304. If, on the other hand, the clamp reaches the clamp position before the expiration of the time interval, this is sensed in block 306 and the tool is retracted to the home position in block 308. The retraction of the tool is given a maximum time interval $t_8$ of, for example, three seconds in block 310 after which the fault lamp is blinked in block 312 if the time interval has expired. If the tool reaches the home position before the expiration of the time interval $t_8$, this is sensed in block 314 and then block 316 causes the ready lamp to be turned off and the timer to be reset. Block 318 turns on the "remove book" lamp, indicating that the book has been bound and is ready for removal. A sensor is checked in block 320 to determine if the book has been removed and once the book is removed, the "remove book" lamp is turned off in block 322. The clamp is then moved to a home position in block 324 and, as before, a time interval $t_9$ of, for example, two seconds is permitted in block 326 for the clamp to move to the home position before the fault lamp is blinked in block 328. The home position of the clamp is sensed in block 330, after which the cartridge switch is checked to determine whether it is empty or not at block 332. Activation of the cartridge switch causes ejection of the cartridge at block 334, while lack of activation transfers process control at connector F to the portion of the process shown at the bottom of FIG. 15.

Figure 18:
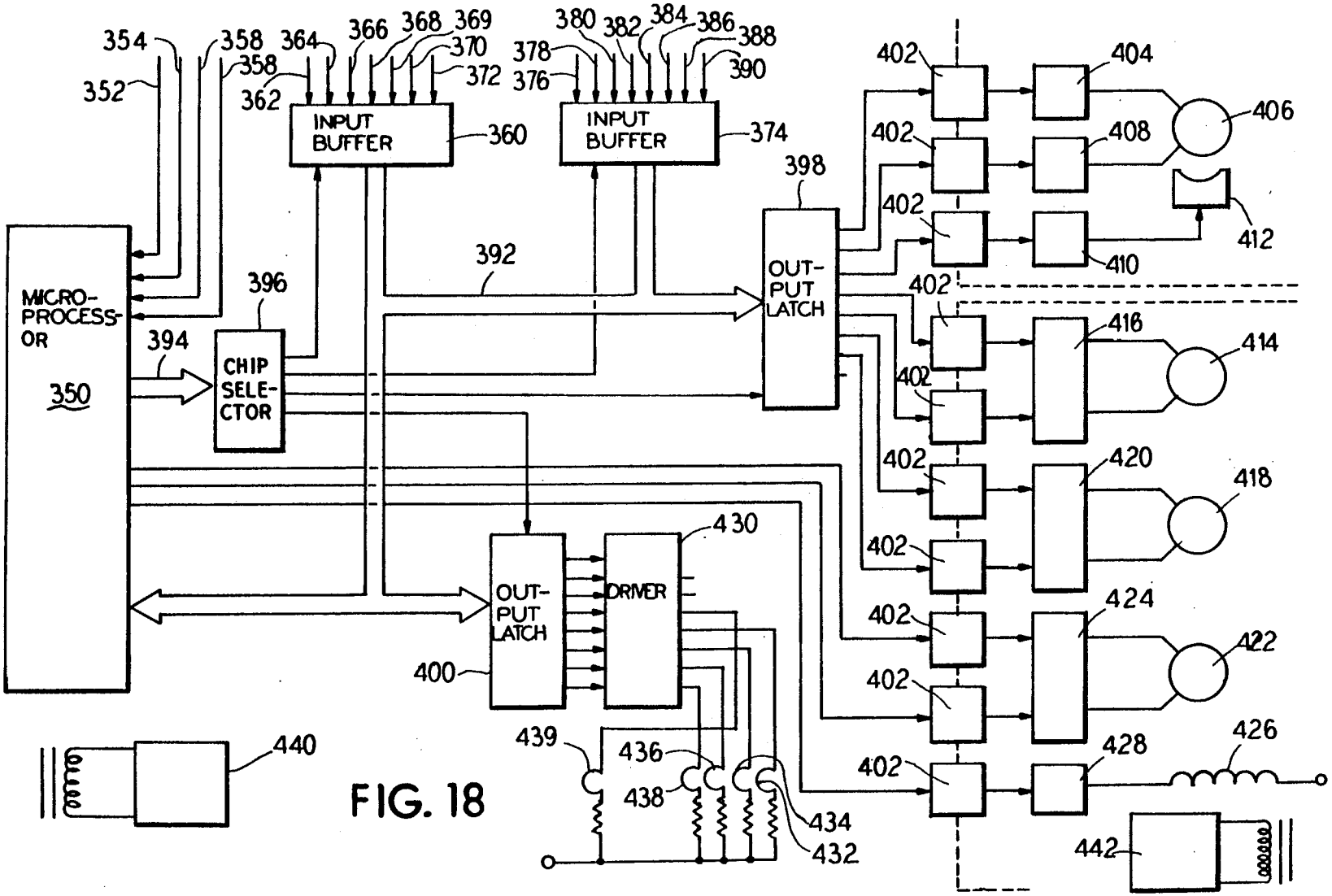
FIG. 18 is a schematic circuit block diagram of a control circuit for controlling the operation of the combined binding and punching machine in accordance with the flow chart of FIGS. 14–17.

FIG. 18 shows a circuit for carrying out the control process shown in FIGS. 14–17. In particular, a microprocessor 350 is programmed with the necessary software or firmware to follow the control process. In detail, an input line 352 to the microprocessor informs the microprocessor of the condition of the power switch, whether it is on or off, while input lines 354 and 356 transmit signals from the cartridge switch and the cartridge sensor, respectively. A clamp position sensor signal is transmitted over the input line 358. Additional input to the microprocessor is fed through a first input buffer 360 and includes, for example, a line 362 for the punch switch, a line 364 for the bind switch, a line 366 for the tool home sensor, an input line 368 for the paper throat sensor, a line 369 for start/reset, and lines 370 and 372 for punch sensors. Additional input lines may be provided as needed. A second input buffer 374 receives a four bit cartridge code over the lines 376, 378, 380 and 382, a punch paper alignment sensor signal from lines 384 and 386, a clamp home sensor signal on line 388 and, finally, a tool mechanism sensor on line 390. The input signals from these input buffers 360 and 374 are fed through a data bus 392 to the microprocessor 350.

To enable the microprocessor 350 to control the various operators and light the various indicators, a control and select bus 394 connects the microprocessor to a chip selector 396 which has outputs connected to the enable inputs of the input buffer 360, the input buffer 374, an output latch 398 and an output latch 400. When enabled by the chip selector 396, the buffers and latches control the flow of data on the data bus 392. The microprocessor based control circuit has an interface with various electromechanical devices through a bank of optical couplers 402. The microprocessor 350 through the data bus 392 and the output latch 398, as well as one of the optical couplers 402, controls a forward drive 404 of a punch motor 406 as well as the reverse drive 408 thereof. Also controlled is the brake drive 410 which operates the brake 412 for the punch. Not only does the microprocessor 350 control the operation of the punch but also the operation of the insertion tools 414 through a forward and reverse drive 416, the paper clamp 418 through a forward and reverse drive 420, the tool drum 422 through a forward and reverse drive 424, and a cartridge solenoid 426 through a solenoid drive 428. The tool drum and the cartridge solenoid are controlled directly by the microprocessor in the illustrated embodiment, rather than through the output latches 398.

The output latches 400, on the other hand, are used to control indicators. In particular, a driver 430 at the output of the latches 400 drive a fault lamp 432, a check cartridge lamp 434, a remove book lamp 436, and a ready lamp 438. A start/reset lamp 439 is also provided. Each of the indicator lamps 432–439 is connected by a resistor to a positive supply. In the illustration of FIG. 18, a power supply 440 is provided for the control circuitry while a separate power supply 442 is provided for the mechanical operators.

Although the invention has been described with respect to preferred embodiments, it is not to be so limited as changes and modifications can be made which are within the full intended scope of the invention as defined by the appended claims.

We claim as our invention:

1. A binding apparatus for use with a cartridge having at least one curled-finger edge-type ring binder and binder data indicating means, which apparatus is adapted to bind prepunched sheets together and to form a booklet, said binding apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of material having prepunched apertures to the binding position;

insertion means which includes a plurality of different sized elongated tool-like members for selection in response to cartridge binder data means and insertion into and retraction out of a binder;

clamping means for movement toward and away from the binding position receiving and holding said sheets of paper during binding; and control means responsive to binder data indicating cartridge for operating and controlling binding functions of said apparatus.

2. A binding apparatus as in claim 1, wherein said guide means, insertion means and clamp are controlled in response to the cartridge binder indicating means.

3. A binding apparatus for use with a cartridge having at least one curled-finger ring-type edge binder and binder data indicating means, which apparatus is adapted to bind prepunched sheets together and form a booklet, said binding apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of material having prepunched apertures to the binding position;

insertion tool means for substantially axial insertion into a binder in a cartridge at the binding position for opening a binder to receive sheets therein and for retraction to close the binder on said sheets;

wherein the insertion means, guide means and cartridge support are arranged at angles relative to each other effective to assure binding alignment of an opened binder relative to sheets deposited therein.

4. A binding apparatus as in claim 3, wherein the insertion tool means includes an elongated tool-like member to be axially inserted into and retracted out of a binder along a substantially horizontal axis.

5. A binding apparatus as in claim 3, wherein said guide means for paper is angularly disponed relative to the horizontal and is forwardly tilted relative to the binding position.

6. A binding apparatus as in claim 5, wherein the angle between the horizontal and the paper guide is substantially 82°.

7. A binding apparatus as in claim 3, wherein said insertion tool means is tilted at a small angle rearwardly from the binding position.

8. A binding apparatus as in claim 7, wherein the insertion tool means is tilted at an angle of substantially 10° relative to the horizontal.

9. A binding apparatus as in claim 3, wherein the angular relationship of the tool means, guide means and cartridge support means relative to each other and the horizontal are as follows:

a. the cartridge means to horizontal is substantially 5° and to the guide means substantially 82°;

b. the guide means to horizontal is substantially 87°; and c. the tool means to horizontal is substantially 10° and the guide means to horizontal is substantially 82°.

10. A binding apparatus as in claim 3, wherein said tool insertion means includes a plurality of insertion tools each different from one another and each being selectably insertable into a binder in response to the cartridge binder data indicating means.

11. A binding apparatus for use with a cartridge having at least one curled-finger ring-type edge binder and binder data indicating means, which apparatus is adapted to bind prepunched sheets together and form a booklet, said binding apparatus comprising:

a base for supporting components of the binding apparatus, means associated with said base defining a binding position at which prepunched sheets are bound with an edge binder to form a booklet;

cartridge support means for supporting a cartridge having at least one binder therein and inserting the same at said binding position;

guide means for guiding sheets of material having prepunched apertures to the binding position;

insertion tool means for substantially axial insertion into a binder in a cartridge at the binding position for opening a binder to receive sheets therein and for retraction to close the binder on said sheets;

wherein the insertion means, guide means and cartridge support are arranged at angles relative to each other effective to assure binding alignment of an opened binder relative to sheets deposited therein; and further including:

means for cooperation with a binder cartridge for receiving data regarding binders therein; and means associated with said binder cooperation means and said insertion tool means for controlling the operation of said insertion tool means based on the data received by the binder cooperating means.

12. A binding apparatus as in claim 3, wherein the cartridge support is aligned at a small angle relative to the horizontal and is tilted toward the binding position.

13. A binding apparatus as in claim 12, wherein said angle is substantially 5°.

14. A binding apparatus as in claim 11, wherein said means for cooperating with binder cooperation means and tool insertion means further includes means for selection of an insertion tool.

15. A binding apparatus for use with a cartridge having at least one curled-finger ring-type edge binder and binder data indicating means, which apparatus is adapted to bind prepunched sheets together and form a booklet, said binding apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of paper having prepunched apertures to the binding position;

insertion tool means for substantially axial insertion into a binder in a cartridge at the binding position for opening a binder to receive sheets therein and for retraction to close the binder on said sheets;

wherein the insertion means, guide means and cartridge support are arranged at angles relative to each other effective to assure binding alignment of an opened binder relative to sheets deposited therein; and wherein the paper guide means includes adjustable means for delivering paper of various thicknesses to said binder, said guide being responsive to binder data indicating means associated with said cartridge.

16. A binder apparatus as in claim 15, wherein said apparatus further includes control means responsive to cartridge binder data indicating means for operating said control system for controlling functions of said apparatus.

17. An apparatus as in claim 16, wherein said tool insertion means are for axial insertion into a binder to open the same and retraction to close the binder and said control means control the operation of said tool insertion means.

18. A binding apparatus for use with a cartridge having at least one curled-finger ring-type edge binder and binder data indicating means, which apparatus is adapted to bind prepunched sheets together and form a booklet, said binding apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of paper having prepunched apertures to the binding position;

insertion tool means for substantially axial insertion into a binder in a cartridge at the binding position for opening a binder to receive sheets therein and for retraction to close the binder on said sheets;

wherein the insertion means, guide means and cartridge support are arranged at angles relative to each other effective to assure binding alignment of an opened binder relative to sheets deposited therein; and which further includes clamping means associated with said cartridge support system and movable toward and away from said binding position for engaging and cooperating in positioning a binder at the binder positioning and for extending into said binding position so as to receive paper from the paper guide and hold the received paper for binding.

19. A system as in claim 18, wherein said clamping system includes plate means mounted for extension and retraction relative to said binding position, said plate defining a plurality of forwardly extending fingers constructed to be positioned between binder rings and being constructed to engage a binder spine and paper in the paper guide.

20. An apparatus for use with a cartridge having at least one curled-finger ring-type edge binder and binder data indicating means, which apparatus is adapted to bind prepunched sheets together and form a booklet, said binding apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of paper having prepunched apertures to the binding position;

insertion tool means for substantially axial insertion into a binder in a cartridge at the binding position for opening a binder to receive sheets therein and for retraction to close the binder on said sheets;

wherein the insertion means, guide means and cartridge support are arranged at angles relative to each other effective to assure binding alignment of an opened binder relative to sheets deposited therein; and wherein drum means are provided for storage, insertion and retraction of the insertion means and wherein there is further provided drive roll means operatively associated with said drum means for extracting said insertion tool from said drum means and inserting said tool into a binder, and wherein second drive means are provided which includes worm gear means for rotating said drum means to an operative position.

21. A binding apparatus for use with a cartridge having at least one curled-finger ring-type edge binder and binder data indicating means, which apparatus is adapted to bind prepunched sheets together and form a booklet, said binder apparatus comprising:

a base for supporting components of the binding apparatus;

means associated with said base defining a binding position at which prepunched sheets are bound with an edge binder to form a booklet;

cartridge support means for supporting a cartridge having at least one binder therein and inserting the same at said binding position;

guide means for guiding sheets of paper having prepunched apertures to the binding position;

insertion means which includes a plurality of different and individually selectable insertion tools for substantially axial insertion into a binder in a cartridge at the binding position for opening a binder to receive sheets therein and for retraction to close the binder on said sheets;

clamping means associated with said cartridge support system and movable toward and away from said binding position for engaging and cooperating in positioning a binder at the binder position and for extending into said binding position so as to receive paper from the paper guide and hold the received paper for binding;

drum means for storage, insertion and retraction of the insertion tool means and drive roll means operatively associated with said drum means for extracting a selected insertion tool from said drum and inserting said tool into said binder and second drive means for rotating said drum to an operative position; and control means responsive to cartridge binder data indicating means for controlling the binding functions of the guide means, insertion means, drum means and clamp means;

and wherein said insertion means, guide means and cartridge support are arranged at angles relative to each other, effective to assure binding alignment of an opened binder relative to the sheets deposited therein.

* * * * *